US009748678B2

(12) United States Patent
Petrarca et al.

(10) Patent No.: US 9,748,678 B2
(45) Date of Patent: Aug. 29, 2017

(54) CONNECTIVITY IN AN ASSEMBLY

(71) Applicant: Sensata Technologies, Inc., Attleboro, MA (US)

(72) Inventors: Neil S. Petrarca, Warwick, RI (US); Keith St. Pierre, Somerset, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 129 days.

(21) Appl. No.: 14/675,255

(22) Filed: Mar. 31, 2015

(65) Prior Publication Data

US 2016/0294080 A1 Oct. 6, 2016

(51) Int. Cl.

| | |
|---|---|
| ***H01R 12/70*** | (2011.01) |
| ***H01R 43/20*** | (2006.01) |
| ***H01R 4/48*** | (2006.01) |
| ***H01R 12/71*** | (2011.01) |
| ***H01R 13/24*** | (2006.01) |

(52) U.S. Cl.

CPC ..... *H01R 12/70* (2013.01); *H01R 4/48* (2013.01); *H01R 12/712* (2013.01); *H01R 13/2421* (2013.01); *H01R 43/205* (2013.01)

(58) Field of Classification Search

CPC .... H01R 4/48; H01R 12/712; H01R 13/2421; H01R 43/205; H01R 13/33

See application file for complete search history.

(56) References Cited

U.S. PATENT DOCUMENTS 2,482,998 A * 9/1949 Andersson ..... A23L 3/22 200/5 EA
3,056,101 A * 9/1962 Bethke ..... H01R 35/04 200/248
3,173,732 A * 3/1965 James ..... H01R 12/7082 361/787
3,317,885 A * 5/1967 Yost ..... H01R 23/70 439/631
3,383,647 A * 5/1968 Duffield ..... H01R 13/33 439/840
4,428,635 A * 1/1984 Hamsher, Jr. ..... H01R 12/89 29/832

(Continued)

FOREIGN PATENT DOCUMENTS

| | | |
|---|---|---|
| EP | 1 760 835 A2 | 3/2007 |
| JP | H10 98281 A | 4/1998 |

OTHER PUBLICATIONS

European Search Report, Application No. EP 16 16 0509, dated Aug. 8, 2016, pp. 2.

*Primary Examiner* — Briggittee R Hammond
(74) *Attorney, Agent, or Firm* — Burns & Levinson LLP; George N. Chaclas; Daniel McGrath

(57) ABSTRACT

A circuit assembly includes one or more electrical conductors. Each of the electrical conductors has a first axial end and a second axial end; the first axial end is disposed opposite the second axial end. The assembly further comprises a non-electrically conductive retainer component operable to: i) retain the electrical conductor and ii) contact a lateral side and/or tip of the electrical conductor onto a conductive pad of a circuit board. The retainer component exerts an appropriate force with respect to the one or more electrical conductors such that, a respective lateral side and/or tip of each of the electrical conductors contact a corresponding electrically conductive pad on the circuit board.

19 Claims, 10 Drawing Sheets

(56) References Cited

U.S. PATENT DOCUMENTS 4,475,782 A * 10/1984 Bartolf ..... H01R 9/28 439/43
4,838,815 A * 6/1989 Tajima ..... H01R 13/33 439/817
5,030,109 A * 7/1991 Dery ..... H01R 12/714 439/66
5,061,191 A * 10/1991 Casciotti ..... H01L 23/4006 257/E23.084
5,080,613 A * 1/1992 Orui ..... H01R 12/737 439/188
5,540,599 A * 7/1996 Bishop ..... H01R 13/2428 439/289
5,941,739 A * 8/1999 Yoo ..... G11B 5/48 439/700
6,128,385 A * 10/2000 Goyal ..... H04M 1/03 379/433.01
6,524,114 B2 * 2/2003 Watanabe ..... H01R 12/721 439/260
7,062,053 B2 * 6/2006 Hohjyo ..... H04R 1/06 381/174
8,129,624 B2 3/2012 Willner et al.
2004/0002234 A1 1/2004 Masao et al.
2007/0032115 A1 * 2/2007 Takashita ..... H01R 12/88 439/260
2011/0059661 A1 * 3/2011 Inomata ..... H01R 13/111 439/841
2012/0003883 A1 * 1/2012 Pavlovic ..... H01R 13/187 439/840
2012/0045948 A1 * 2/2012 Determan ..... B23K 35/00 439/840
2013/0237076 A1 * 9/2013 Mason ..... H05K 7/1069 439/137
2013/0280927 A1 * 10/2013 Thompson ..... H01R 12/72 439/65
2015/0011113 A1 1/2015 Farole

* cited by examiner

CONNECTIVITY IN AN ASSEMBLY

BACKGROUND

Conventional connectors have been used to provide connectivity between disparately located circuits. For example, one type of conventional application includes one or more conductive leads that protrude from a sensor component assembly. The conductive leads in the sensor component assembly provide connectivity between circuitry in the sensor component assembly and a corresponding external electrical system (such as an electronic control system).

BRIEF DESCRIPTION

Unfortunately, conventional connectors are bulky and expensive. In contrast to conventional applications, embodiments herein include unique ways of providing electrical contacts between a circuit board and disparately located electrical system.

More specifically, in one embodiment, an assembly includes an electrical conductor. The electrical conductor has a first axial end and a second axial end; the first axial end is disposed opposite the second axial end. The assembly further comprises a non-electrically conductive retainer component operable to: i) retain the electrical conductor, and ii) contact a lateral side of the electrical conductor at a location between the first axial end and the second axial end onto a conductive pad of a circuit board. In one embodiment, the lateral side or tip of the electrical conductor in contact with the conductive pad is disposed in a vicinity of the second axial end of the electrical conductor.

Additionally, note that in certain instances, the non-electrically conductive retainer component is configured to retain any number of electrical conductors for contact to respective conductive pads on the circuit board.

In accordance with further more specific embodiments, the non-electrically conductive retainer component includes a hinge about which the electrical conductor pivots in the retainer component. In such an instance, a pivoting movement about the hinge resource provides a force in which to contact the side of the electrical conductor to the conductive pad on the circuit board.

In accordance with yet further embodiments, the assembly can include a housing disposed (such as clamped) over a portion of the non-electrically conductive retainer component. The housing exerts a pivot force about the hinged portion of the non-electrically conductive retainer component; the pivot force about the hinged portion causes the lateral side of the electrical conductor to contact the conductive pad on the circuit board. Thus, a hinged portion of the retainer resource can be sufficiently flexible to allow exertion of the force on the lateral side of the electrical conductor to contact the circuit pad.

Additionally or alternatively, the non-electrically conductive retainer component can be configured to include an opening through which the lateral side or tip of the electrical conductor is exposed and protrudes to contact the conductive pad of the circuit board.

Still further, the non-electrically conductive retainer component can be configured to include a hollowed volume through which the a portion of the electrical conductor slidably passes. The hollowed volume (or cavity) can be configured to include a biasing wedge that forces and or steers the lateral side of the electrical conductor to contact the conductive pad of the circuit board. More specifically, during use such as when the spring is compressed based upon application of a force at a tip of the electrical conductor, sliding and compressing of the electrical conductor in the hollowed volume causes the biasing wedge to direct the tip and or lateral side of the electrical conductor to and through the opening in the retainer component to contact the electrical conductor to the conductive pad of the circuit board.

Each of the electrical conductors in the retainer component can be of any suitable shape or size. In one embodiment, each of the electrical conductors is a coiled spring that compresses along an axial length of the electrical conductor between the first axial end and the second axial end, the lateral side and or tip being a surface region of at least one loop of the coiled spring.

In accordance with further embodiments, respective diameters of loops in the coiled spring vary along an axial length of the coiled spring. For example, in one embodiment, a diameter of the coiled spring at the location of the electrical conductor in contact with the conductive pad can be substantially greater than a diameter of the coiled spring at a location of the coiled spring protruding from the non-electrically conductive retainer component. The increasing diameter size of the coiled spring loops nearer the second axial end of the electrical conductor render it easier to contact the coiled spring to a respective circuit pad of the circuit board.

Accordingly, embodiments herein include a number of different ways (increased diameter of the electrical conductor, biasing wedge, etc.) in which to provide connectivity of a lateral side or tip of an electrical conductor to a corresponding conductive pad of a circuit board.

These and other embodiment variations are discussed in more detail below.

Note that embodiments herein can include a configuration of one or more fabrication resources such as computerized devices, hardware processor devices, assemblers, or the like to carry out and/or support any or all of the method operations disclosed herein. In other words, one or more computerized devices, processors, digital signal processors, assemblers, etc., can be programmed and/or configured to perform any of the operations or methods as discussed herein.

Additionally, although each of the different features, techniques, configurations, etc., herein may be discussed in different places of this disclosure, it is intended that each of the concepts can be executed independently of each other or executed in combination with each other. Accordingly, the one or more present inventions, embodiments, etc., as described herein can be embodied and viewed in many different ways.

Also, note that this preliminary discussion of embodiments herein does not specify every embodiment and/or incrementally novel aspect of the present disclosure or claimed invention(s). Instead, this brief description only presents general embodiments and corresponding points of novelty over conventional techniques. For additional details and/or possible perspectives (permutations) of the invention(s), the reader is directed to the Detailed Description section and corresponding figures of the present disclosure as further discussed below.

Figure 1:
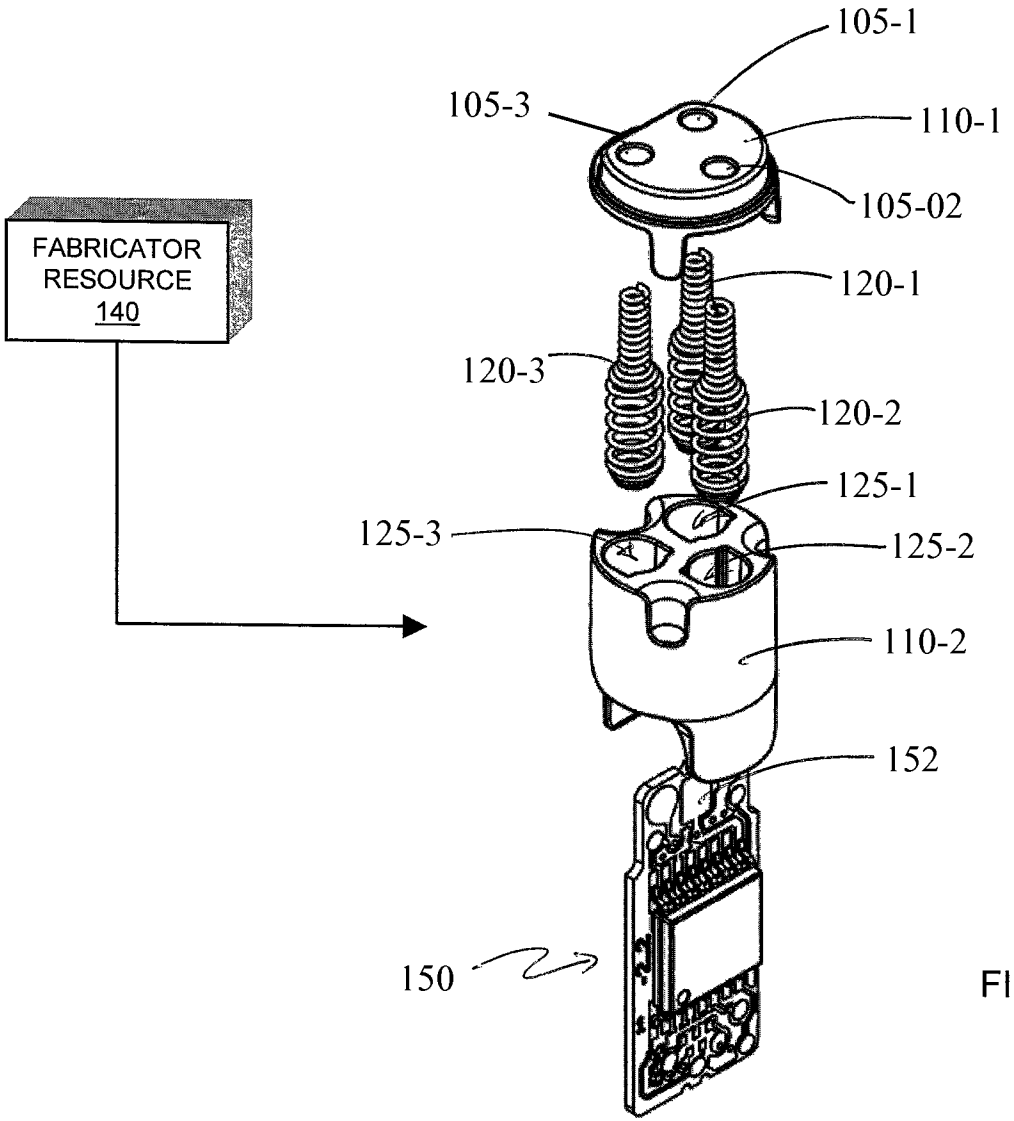
FIG. 1 is an example exploded perspective diagram of an assembly and corresponding components according to embodiments herein.

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

DETAILED DESCRIPTION

Embodiments herein include a circuit assembly. The circuit assembly includes one or more electrical conductors. Each of the electrical conductors has a first axial end and a second axial end; the first axial end is disposed opposite the second axial end. The assembly further comprises a non-electrically conductive retainer component operable to: i) retain the electrical conductor and ii) contact a lateral side and or tip of the electrical conductor onto a conductive pad of a circuit board.

In one embodiment, a biasing wedge disposed in a cavity of the retainer component directs a respective lateral side and or tip of an electrical conductor to a respective node on a circuit board. In another embodiment, the retainer component exerts an appropriate force with respect to the one or more electrical conductors such that, a respective lateral side of each of the electrical conductors contacts a corresponding conductive pad on the circuit board.

Now turning to the figures, FIG. 1 is an example exploded perspective view diagram of an assembly according to embodiments herein.

As shown, the assembly 100 includes retainer component 110-1 (such as made of plastic, ceramic, etc.), one or more electrical conductors 120-1, 120-2, and 120-3 (such as made of metal or metal alloy including copper, aluminum, tuning, etc.), retainer component 110-2 (such as made of plastic, ceramic, etc.), and circuit board 150.

Retainer component 110-1 includes the respective openings 105-1, 105-2, and 105-3. Retainer component 110-2 includes respective cavities 125-1, 125-2, and 125-3.

Circuit board 150 includes one or more circuit pads including circuit pad 152 (such as made of metal).

As further discussed herein, fabrication resource 140 produces a respective assembly 100. In this example embodiment, fabrication of assembly 100 includes: inserting the respective base portion of electrical conductor 120-1 into cavity 125-1, inserting the respective base portion of electrical conductor 120-2 into cavity 125-2, inserting the respective base portion of electrical conductor 120-3 into cavity 125-3.

Subsequent to insertion of the lower portion of the electrical conductors 120 into respective cavities 125, the fabricator resource 140 mates the retainer component 110-1 to the retainer component 110-2. This can include passing respective openings 105 of the retainer component to 110-1 over at least a portion of the electrical conductors 120. More specifically, note that the diameter of each of the openings 105 enables the upper tips of the electrical conductors to pass through and protrude out from the retainer component 110-1.

The diameter of each of the base portions of the electrical conductors 120 is substantially larger than the diameter of respective openings 105. Accordingly, subsequent to inserting the respective electrical conductors 120 into respective cavities 125 and mating of the retainer component 110-1 to the retainer component 110-2, the electrical conductors 120 are secured within the retainer component 110.

Further note that the diameters of respective cavities 125 are sufficiently large with respect to the outer diameter of the base portion of the electrical conductors 120 such that the base portions of the electrical conductors 120 are able to slide within the respective cavities 125.

As further discussed below, at least a portion of each lateral side and/or tip of the conductors 120 disposed in the cavities 125 contacts a respective circuit pad on the circuit board 150.

Figure 2:
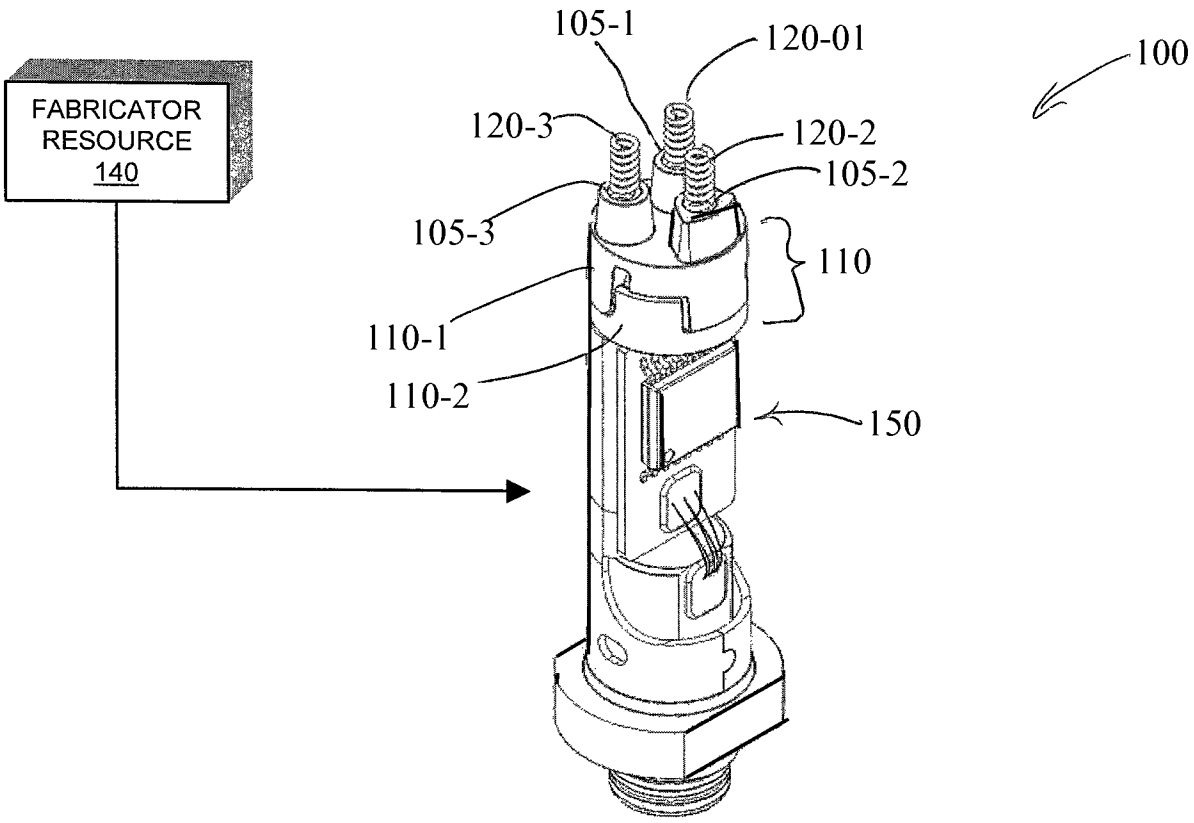
FIG. 2 is an example perspective view diagram of an assembly according to embodiments herein.

FIG. 2 is an example perspective view diagram of an assembly according to embodiments herein.

This view of the assembly 100 illustrates mating of the retainer component 110-1 to the retainer component 110-2, securing the base portion of the electrical conductors in respective cavities 125. As further shown, in the assembly 100, axial end of electrical conductor 120-1 protrudes out of opening 105-1; axial end of electrical conductor 120-2 protrudes out of opening 105-2; axial end of electrical conductor 120-3 protrudes out of opening 105-3 of the retainer component 110.

Figure 3B:
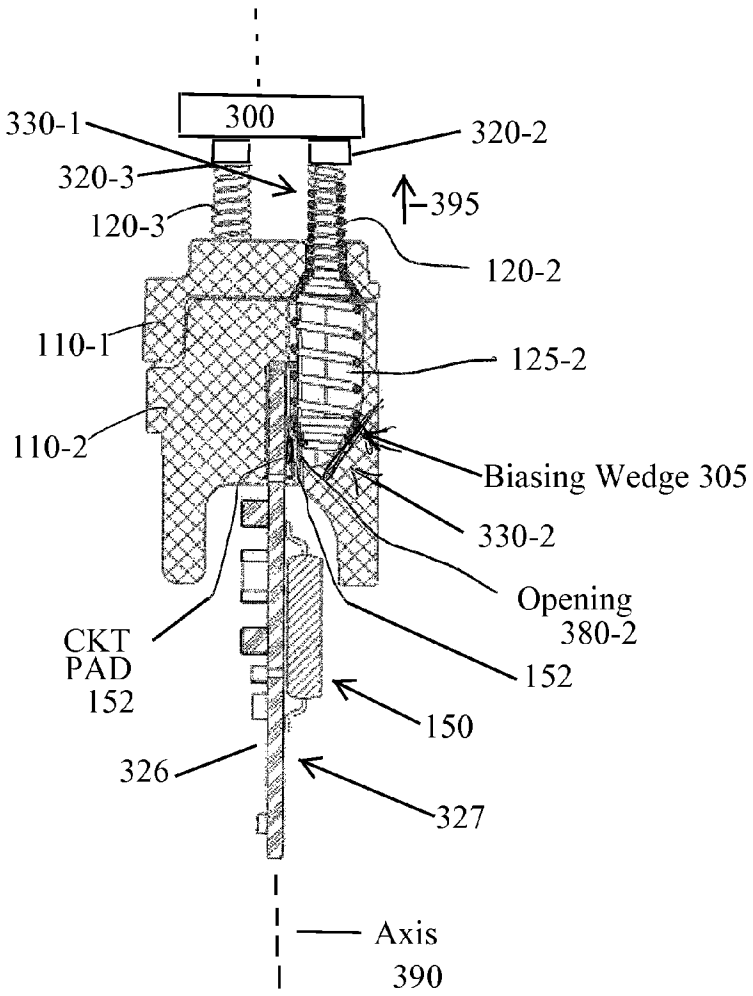
FIG. 3B is an example cutaway side view diagram of an assembly according to embodiments herein.
Figure 3A:
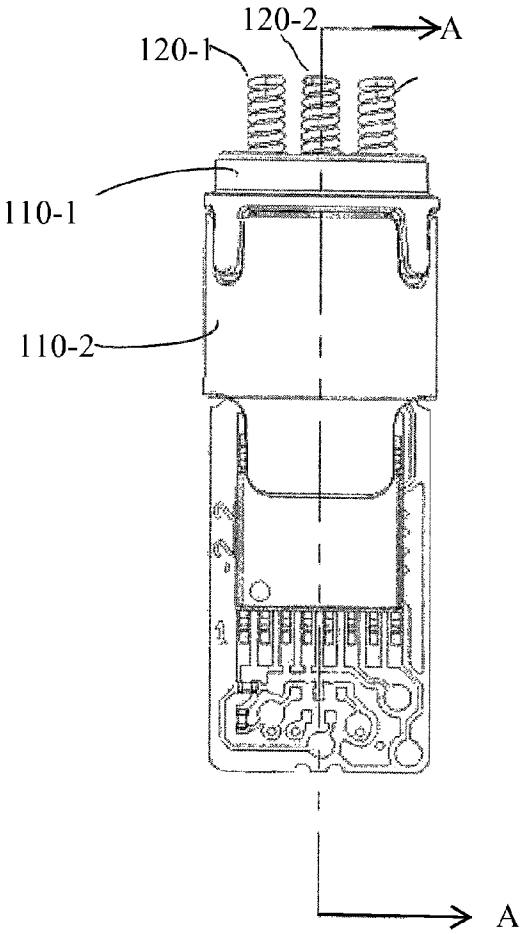
FIG. 3A is an example side view diagram of an assembly according to embodiments herein.

FIG. 3A is an example side view diagram of assembly according to embodiments herein.

FIG. 3B is an example cutaway side view diagram of the assembly in FIG. 3 according to embodiments herein.

In this example embodiment, as previously discussed, axial end 330-1 of the electrical conductor 120-2 protrudes from opening 105-2. The base portion (at axial end 330-2) of the electrical conductor 120-2 is retained and resides in cavity 125-2.

A portion of the circuit board 150 resides in a cavity formed in the retainer component 110-2. The circuit board 150 is substantially planar in shape and resides substantially parallel with respect to axis 390.

In one embodiment, the electrical conductor 120-2 (such as a compressible spring) slidably moves within the cavity 125-2. A downward force 395 applied along axis 390 to the tip at axial end 330-1 of the of the electrical conductor 120-2 causes the electrical conductor 120-2 to compress as well as slide within the cavity 125-2 towards the circuit pad 152.

More specifically, application of the force 395 (such as caused by contacting the node 320-2 of electrical system 300 to the axial end 330-1 of electrical conductor 120-2) causes the biasing wedge 305 disposed in the cavity 125-2 to direct and steer a portion (such as a tip and or lateral side) of the electrical conductor 120-2 at the axial end 330-2 through opening 380-2 of the retainer component 110-2 in contact with the circuit pad 152 exposed on a respective facing 327 of the circuit board 150.

As previously discussed, the retainer component 110 can be configured to include any number of electrical conductors. In a similar manner, application of respective force 395 from the node 320-3 (associated with electrical system 300) to the electrical conductor 120-3 causes an axial end of the electrical conductor 120-3 (based on steering of a tip of the electrical conductor 120-3 via a biasing wedge in a respective cavity 125-3) to contact a respective circuit pad on facing 326 of the circuit board 150.

Accordingly, embodiments herein can include multiple electrical conductors that provide respective connectivity between the circuit pads disposed on the circuit board 150 and respective nodes 320 of the electrical system 300. More specifically, as previously discussed, the non-electrically conductive retainer component 110 can be configured to include an opening 380-2 through which the tip and or lateral side of the electrical conductor 120-2 in a vicinity of axial end 330-2 is exposed and protrudes to contact the conductive pad 152 of the circuit board 150. The non-electrically conductive retainer component 110 includes a hollowed volume (cavity 125-2) through which the electrical conductor 120-2 slidably passes. An end of the cavity 125-2 including the biasing wedge 305 (angled cavity wall towards the contact pad 152) forces the lateral side and/or tip of the sliding electrical conductor 120-2 to contact the conductive pad 152 of the circuit board 150.

The greater the force 395 applied to the axial and 330-one of the electrical conductor 120-2, the greater the force that the axial end 330-2 of the electrical conductor 120-2 applies to contact the respective contact pad 152 on the circuit board 150.

Figure 4B:
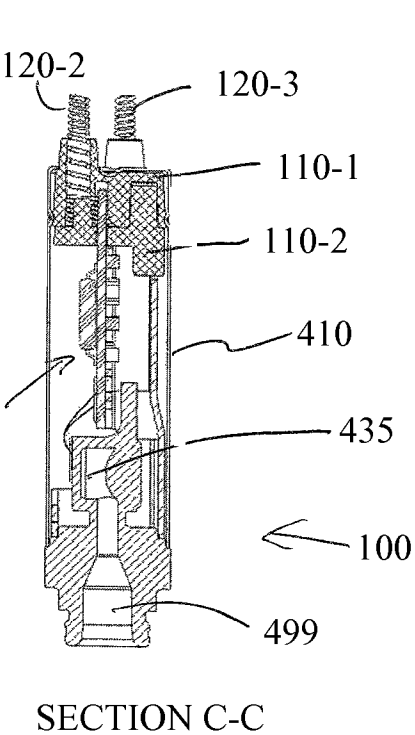
FIG. 4B is an example diagram illustrating a cutaway side view diagram of an assembly according to embodiments herein.
Figure 4A:
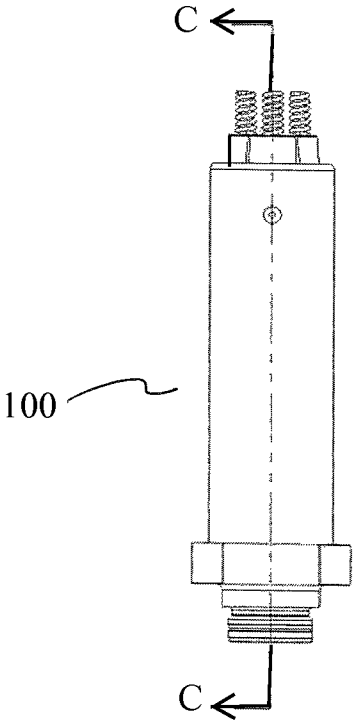
FIG. 4A is an example side view diagram of an assembly according to embodiments herein.

FIG. 4A is an example side view of diagram illustrating an assembly according to embodiments herein.

FIG. 4B is an example cutaway side view diagram illustrating an assembly according to embodiments herein.

This example diagram includes an illustration of housing 410 that protects a combination of circuit board 150, retainer assembly (including retainer component 110-1 and retainer component 110-2), electrical conductors 120, etc.

In one embodiment, the assembly 100 includes a respective sensor 435 (such as a pressure sensor) that generates respective one or more voltage signals (based on pressure passing through conduit 499 to sensor 435) subsequently processed by the circuitry on circuit board 150.

Figure 5:
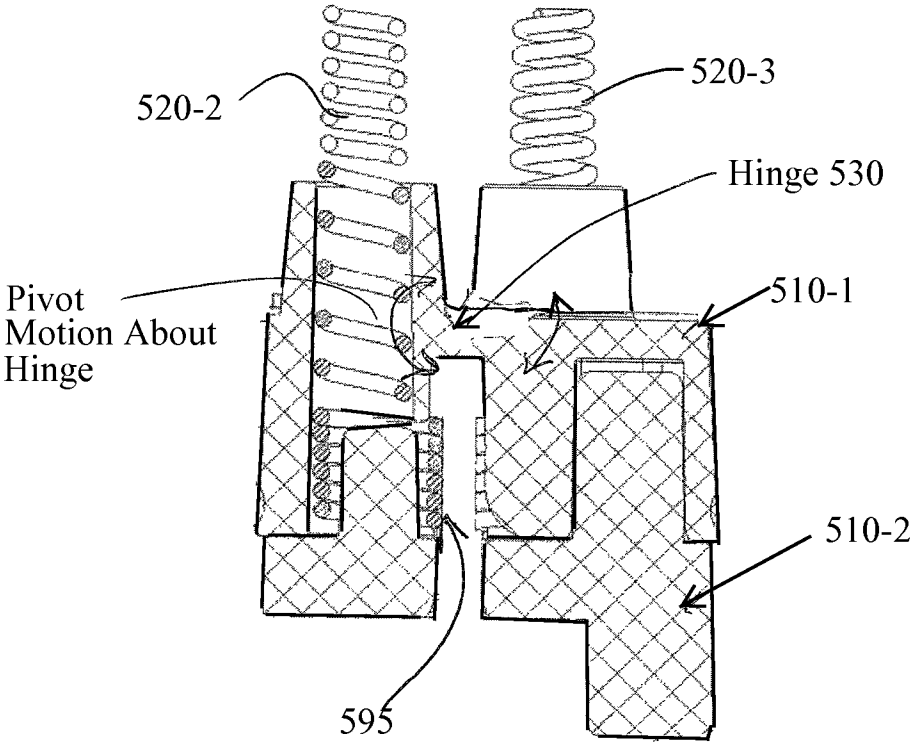
FIG. 5 is an example cutaway side view diagram of an assembly according to embodiments herein.

FIG. 5 is an example cutaway side view diagram of assembly according to embodiments herein.

In this example embodiment, the non-electrically conductive retainer components 510-1 and 510-2 (collectively, retainer assembly 510) includes a hinge 530 about which the electrical conductors 520-2 and 520-3 pivot in the retainer component 510-1. More specifically, in this example embodiment, the hinge 530 enables electrical conductor 520-2 and electrical conductor 520-3 to pivot about an axis of rotation 540 (FIG. 5 illustrates a side view drawing of the axis into the page).

Further in this example embodiment, a portion of the lateral side of the electrical conductor 520-2 extends through a respective opening 595 in the retainer component 510-1. As further discussed below, the pivoting movement of the portions of the retainer assembly 510 and corresponding electrical conductors 520-2 and 520-3 about the hinge 530 provides a force in which to contact the lateral side of the electrical conductor 520-2 and 520-3 onto respective conductive pads of a circuit board as further discussed below.

Figure 6:
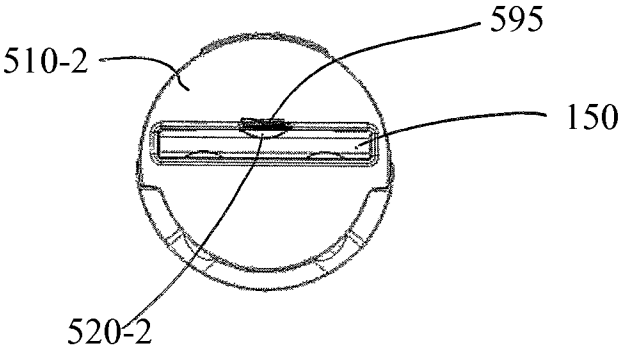
FIG. 6 is an example bottom view diagram of a retainer component and electrical conductors according to embodiments herein.

FIG. 6 is an example bottom view diagram of a retainer component according to embodiments herein.

As shown, the lateral side of the electrical conductor 520-2 sufficiently passes through the opening 595 of the retainer component 510-2 for contacting a respective contact pad on the circuit board 150.

Figure 7:
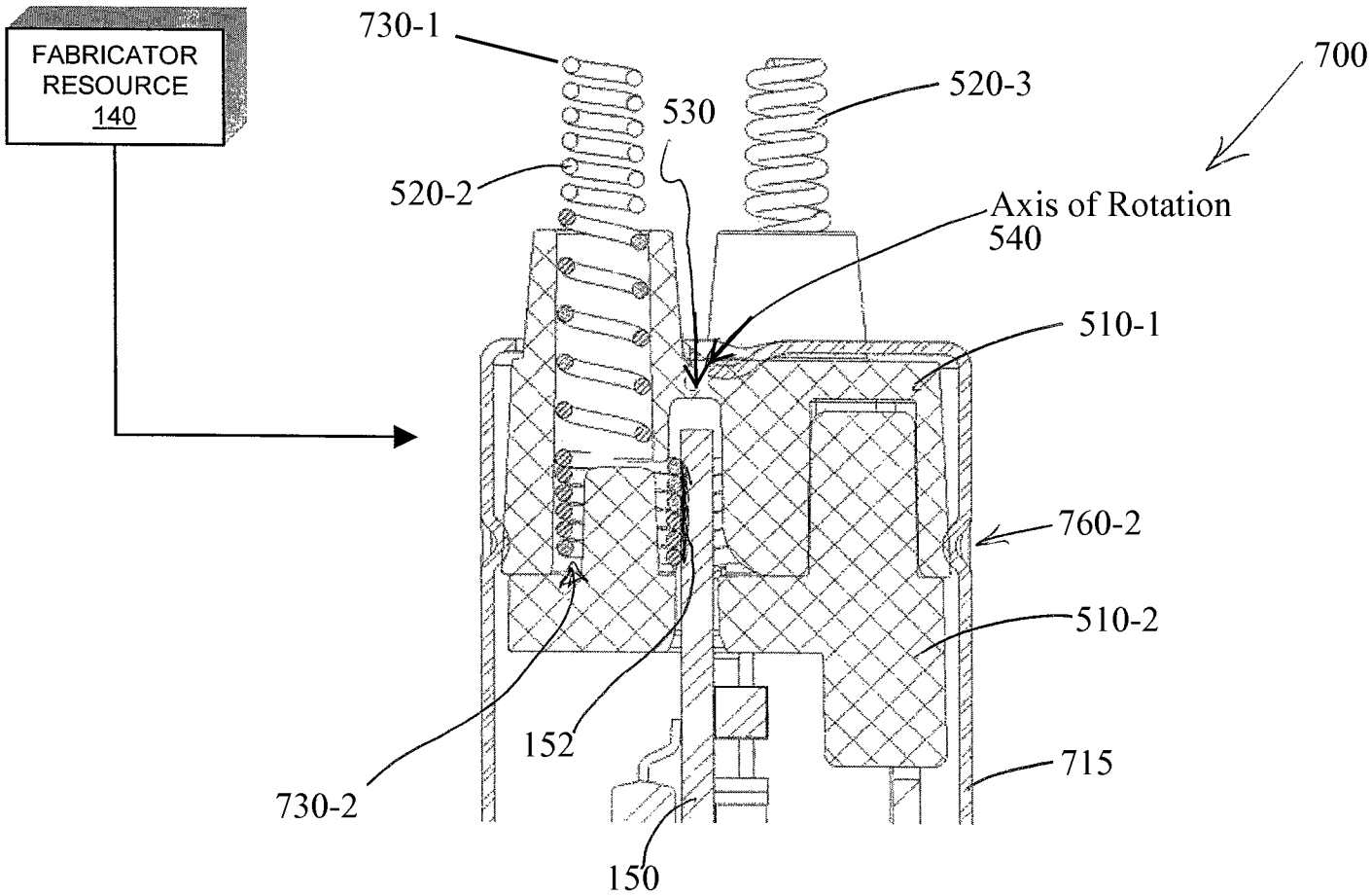
FIG. 7 is an example cutaway side view diagram of a populated retainer component and corresponding assembly according to embodiments herein.

FIG. 7 is an example cutaway side view diagram of a populated retainer component and corresponding assembly according to embodiments herein.

In accordance with yet further embodiments, the assembly 700 can include a housing 715 disposed (or clamped) over a portion of the non-electrically conductive retainer component 510. A portion of circuit board 150 resides in a respective cavity of the retainer assembly 510. Circuit board 150 is substantially planar in shape and resides parallel to an axial length of each of the electrical conductors 520.

In this example embodiments, the housing 715 and/or corresponding crimps 760 (crimps 760-1, crimps 760-2, etc.) inward on a respective sidewalls of the housing 715 exert a pivot movement and force about the hinged portion 530 of the non-electrically conductive retainer component 510; the pivot movement and force about the hinged portion 530 applies a respective force on the retainer assembly 510 below the hinge 530, causing the lateral side of the electrical conductor 520-2 to contact the conductive pad 152 on the circuit board 150. Thus, a hinged portion 530 of the retainer resource 510 can be sufficiently flexible to allow translation of the force from the crimps 760 through the retainer assembly 510 to exert an appropriate force on the electrical conductor 520-2 to contact a lateral side of the electrical conductor 520-2 through opening 595 to contact the circuit pad 152.

As previously discussed, in a similar manner, and axial tip of the electrical conductor 520-3 disposed on an opposite side of the hinge 530 contacts a respective contact pad on the opposite side of the circuit board 150.

Figure 8:
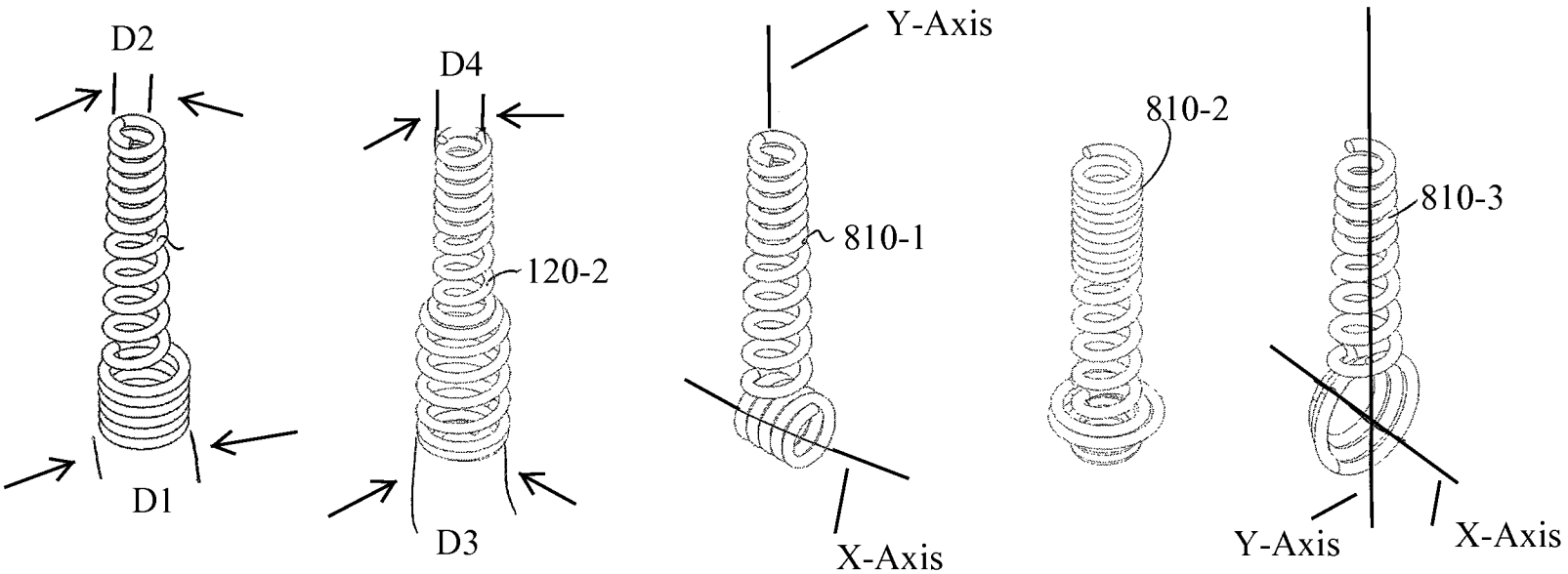
FIG. 8 is an example diagram illustrating different views and shapes of electrical conductors according to embodiments herein.

FIG. 8 is an example diagram illustrating different views of electrical conductors according to embodiments herein.

As previously discussed, each of the electrical conductors retained within the retainer component can be of any suitable shape or size. By way of non-limiting example embodiment, each of the electrical conductors can be a coiled spring that compresses along an axial length of the electrical conductor between the first axial end and the second axial end, the lateral side being a surface region of at least one loop of the coiled spring.

In accordance with certain embodiments, respective diameters of loops in the coiled spring vary along an axial length of the coiled spring. As further shown, in certain instances, a density of the number of axial loops along a respective axial length of an electrical conductor can vary as well.

More specifically, in one embodiment, a diameter D1 of a respective location (such as one or more loops) of the electrical conductor 720-2 in contact with the conductive pad 152 can be substantially greater than a diameter D2 of loops of the electrical conductor 720-2 at a location of the electrical conductor 720-2 protruding from the assembled retainer component 110. Accordingly, embodiments herein can include increasing a diameter size of one or more loops of the electrical conductor 720-2 nearer the circuit board 150, while loops of the electrical conductor 720-2 at the opposite end are of smaller diameter.

In accordance with further embodiments, a diameter D3 of a respective location (such as one or more loops) of the electrical conductor 120-2 in contact with the conductive pad 152 can be substantially greater than a diameter D4 of the electrical conductor 120-2 at a location of the electrical conductor 120-2 protruding from the assembled retainer component 110. Accordingly, embodiments herein can include increasing a diameter size of one or more loops of the electrical conductor 120-2 that are to be disposed nearer the circuit board 150. As previously discussed, the diameter D3 is substantially larger than a diameter of the respective opening 105-2 in the retainer component 110-1. Accordingly, the conductor 120-2 is retained within the respective cavity 125-2.

As further shown, in addition to varying in diameter, one or more loops of a respective electrical conductor can be disposed in different directions to contact a respective node on a circuit board 150.

For example, electrical conductor 810-1 includes multiple coil loops disposed about the Y-axis and multiple coil loops disposed about the X-axis.

Additionally, as further shown, example electrical conductor 810-2 includes one or more outer-coil loops disposed about one or more respective inner-coil loops.

Finally, example electrical conductor 810-3 includes a first set of coil loops of a first diameter disposed about the Y-axis and a second set of coil loops of a second diameter disposed about the X-axis.

Figure 9:
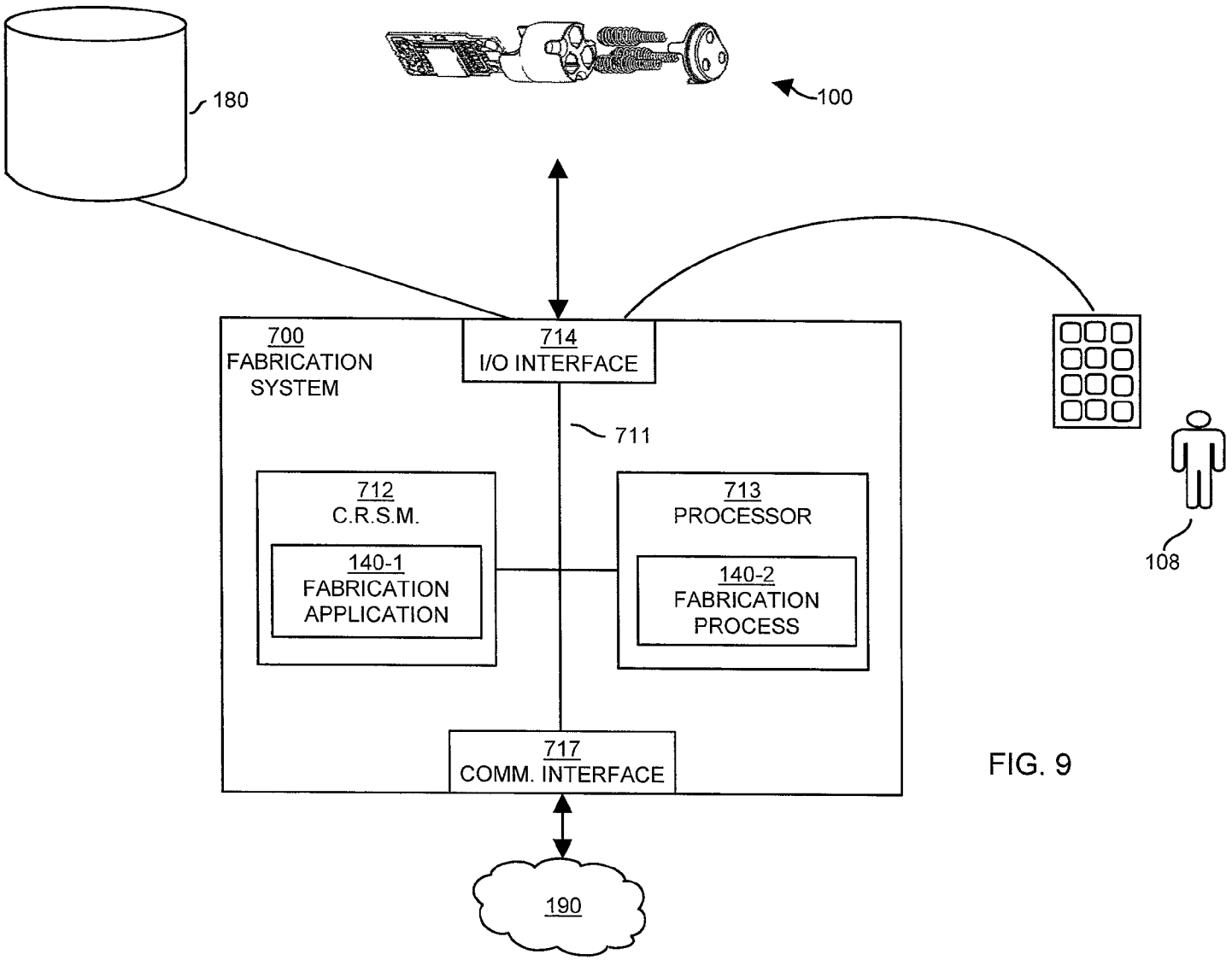
FIG. 9 is an example fabrication system diagram including computer processor hardware to execute operations according to embodiments herein.

FIG. 9 is an example block diagram of a fabrication system for implementing any of the operations as discussed herein according to embodiments herein.

As shown, fabrication system 700 (such as including one or more computers) of the present example includes an interconnect 711, a processor 713 (such as one or more processor devices, computer processor hardware, etc.), computer readable storage medium 712 (such as hardware storage to store instructions, data, information, etc.), I/O interface 714, and communications interface 717.

Interconnect 711 provides connectivity amongst processor 713, computer readable storage media 712, I/O interface 714, and communication interface 717.

I/O interface 714 provides connectivity to a repository 180 and, if present, other devices such as a playback device, display screen, input resources, a computer mouse, etc.

Computer readable storage medium 712 (such as a non-transitory computer-readable storage medium or hardware medium) can be any suitable hardware storage resource or device such as memory, optical storage, hard drive, rotating disk, etc. In one embodiment, the computer readable storage medium 712 stores instructions associated with fabrication application 140-1. Processor 713 (computer processor hardware) executes these instructions.

Communications interface 717 enables the fabrication system 700 and processor 713 (computer processor hardware) to communicate over a resource such as network 190 to retrieve information from remote sources and communicate with other computers. I/O interface 714 further enables processor 713 executing fabrication application 140-1 to retrieve stored information such as from repository 180.

As shown, and as previously discussed, computer readable storage media 712 is encoded with the fabrication application 140-1 (e.g., software, firmware, etc.) executed by processor 713 (hardware). Fabrication application 140-1 is configured to include instructions to implement any of the injection molding operations as discussed herein.

During operation of one embodiment, processor 713 (e.g., computer processor hardware) accesses computer readable storage media 712 via the use of interconnect 711 in order to launch, run, execute, interpret or otherwise perform the instructions in the fabrication application 140-1 stored on computer readable storage medium 712.

Execution of the fabrication application 140-1 produces processing functionality such as fabrication process 140-2 in processor 713. In other words, the fabrication process 140-2 associated with processor 713 represents one or more aspects of executing fabrication application 140-1 within or upon the processor 713 in the fabrication system 700.

Those skilled in the art will understand that the fabrication system 700 and corresponding processor 713 can include other processes and/or software and hardware components, such as an operating system that controls allocation and use of hardware resources to execute fabrication application 140-1.

In accordance with different embodiments, note that computer system may be any of various types of devices, including, but not limited to, a controller, a wireless access point, a mobile computer, a personal computer system, a wireless device, base station, phone device, desktop computer, laptop, notebook, netbook computer, mainframe computer system, handheld computer, workstation, network computer, application server, storage device, a consumer electronics device such as a camera, camcorder, set top box, mobile device, video game console, handheld video game device, a peripheral device such as a switch, modem, router, or in general any type of computing or electronic device. The computer system 850 and its parts may reside at any of one or more locations or can be included in any suitable one or more resource in network environment 100 to implement functionality as discussed herein.

Functionality supported by the different resources will now be discussed via flowchart in FIG. 10. Note that the steps in the flowcharts below can be executed in any suitable order.

Figure 10:
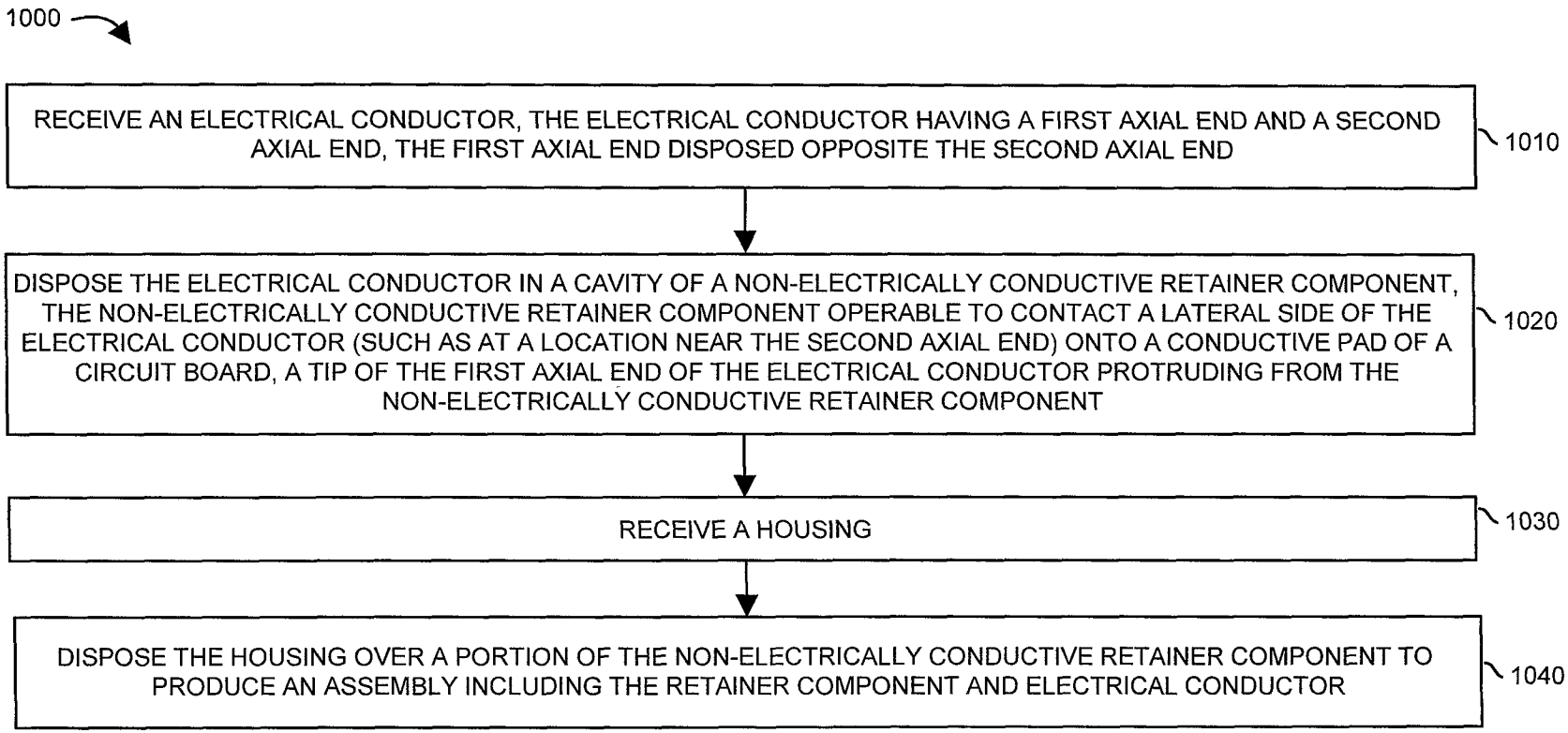
FIG. 10 is an example flowchart illustrating a method according to embodiments herein.

FIG. 10 is a flowchart 1000 illustrating an example method according to embodiments. Note that there will be some overlap with respect to concepts as discussed above. More specific details of the method 1000 are discussed above.

In processing block 1010, the fabricator resource 140 receives an electrical conductor 120-2. The electrical conductor 120-2 has a first axial end 330-1 and a second axial end 330-2. The first axial end 330-1 is disposed opposite the second axial end 330-2.

In processing block 1020, the fabricator resource 140 disposes the electrical conductor 120-2 in a cavity 125-2 of (non-electrically conductive) retainer component 110. The retainer component is operable to contact a lateral side and/or tip of the electrical conductor (such as at a location near the second axial end 330-2 through opening 380-2) onto a conductive pad 152 of a circuit board 150. A tip of the first axial end 330-1 of the electrical conductor 120-2 protrudes out of the opening 105-2 from the retainer component 110.

In processing block 1030, the fabricator resource 140 receives a housing 410.

In processing block 1040, the fabricator resource 140 disposes the housing 410 over a portion of the retainer component 110 to produce an assembly 100 including the retainer and corresponding electrical conductors 120.

Based on the description set forth herein, numerous specific details have been set forth to provide a thorough understanding of claimed subject matter. However, it will be understood by those skilled in the art that claimed subject matter may be practiced without these specific details. In other instances, methods, apparatuses, systems, etc., that would be known by one of ordinary skill have not been described in detail so as not to obscure claimed subject matter. Some portions of the detailed description have been presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm as described herein, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has been convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

While one or more inventions have been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

We claim:

1. An assembly for connecting an electrical system to a circuit board, the assembly comprising:

an electrical conductor having a first axial end and a second axial end, the first axial end disposed opposite the second axial end; and a non-electrically conductive retainer component operable to retain the electrical conductor, the non-electrically conductive retainer component including a hinged portion to exert a force on a lateral side of the electrical conductor at a location between the first axial end and the second axial end, bringing the electrical conductor into contact with a conductive pad of the circuit board.

2. The assembly as in claim 1, wherein a tip of the first axial end of the electrical conductor protrudes from the non-electrically conductive retainer component to contact a node of the electrical system, the electrical conductor configured to electrically couple the conductive pad of the circuit board to the node of the electrical system.

3. The assembly as in claim 2, wherein the lateral side of the electrical conductor is disposed in a vicinity of an axial tip of the electrical conductor at the second axial end.

4. The assembly as in claim 1, wherein the non-electrically conductive retainer component includes an opening through which the lateral side of the electrical conductor is exposed and protrudes to contact the conductive pad of the circuit board.

5. The assembly as in claim 4, wherein the non-electrically conductive retainer component includes a hollowed volume through which the electrical conductor slidably passes, the hollowed volume including a biasing wedge that forces the lateral side of the electrical conductor to contact the conductive pad of the circuit board.

6. The assembly as in claim 5, wherein slidable insertion of the electrical conductor into the hollowed volume causes the biasing wedge to direct the lateral side of the electrical conductor to contact the conductive pad of the circuit board.

7. The assembly as in claim 1 further comprising: a housing disposed over a portion of the non-electrically conductive retainer component, the housing exerting a pivot force about the hinged portion of the non-electrically conductive retainer component, the pivot force about the hinged portion causing the lateral side of the electrical conductor to contact the conductive pad on the circuit board.

8. The assembly as in claim 1, wherein the electrical conductor is a coiled spring that compresses along an axial length of the electrical conductor between the first axial end and the second axial end, the lateral side being a surface region of at least one loop of the coiled spring.

9. The assembly as in claim 8, wherein respective diameters of loops in the coiled spring vary along an axial length of the coiled spring.

10. The assembly as in claim 8, wherein a diameter of the coiled spring at a location of the electrical conductor in contact with the conductive pad is substantially greater than a diameter of the coiled spring at a location of the coiled spring protruding from the non-electrically conductive retainer component.

11. An electrical connection assembly for connecting an electrical system to a circuit board, the electrical connection assembly comprising:

an elongated electrical conductor extending along an axis, the elongated electrical conductor having a proximal end for coupling to the electrical system and a distal end for coupling to the circuit board; and a non-electrically conductive retainer component defining: a first cavity substantially parallel to the axis for retaining the electrical conductor; and a second cavity so that when the circuit board is in the second cavity, a circuit pad of the circuit board is accessible from the first cavity, wherein the first cavity is shaped to bias a lateral side of the electrical conductor onto the circuit pad when the electrical conductor is inserted into the first cavity and an insertion force is applied thereto.

12. The electrical assembly as in claim 11, wherein the circuit board is substantially planar and resides substantially parallel with respect to the axis and the electrical conductor is a compressive spring.

13. The assembly as in claim 11, wherein a cavity wall opposing the contact pad is angled to bias the electrical conductor.

14. The assembly as in claim 11, wherein the non-electrically conductive retainer component includes an opening between the first and second cavities through which a lateral side of the electrical conductor is exposed and protrudes to contact the conductive pad of the circuit board.

15. The assembly as in claim 11, wherein the non-electrically conductive retainer component includes a hinged portion to exert a force on the lateral side of the electrical conductor to contact the conductive pad of the circuit board.

16. The assembly as in claim 15 further comprising: a housing, the housing disposed over a portion of the non-electrically conductive retainer component, the housing exerting a pivot force about the hinged portion of the non-electrically conductive retainer component, the pivot force about the hinged portion causing the lateral side of the electrical conductor to contact the conductive pad on the circuit board.

17. An electrical connection assembly for connecting an electrical system to a circuit board, the electrical connection assembly comprising:

an elongated electrical conductor extending along an axis, the elongated electrical conductor having a proximal end for coupling to the electrical system and a distal end for coupling to the circuit board;

a non-electrically conductive retainer component defining: a first cavity substantially parallel to the axis for retaining the electrical conductor; and a second cavity so that when the circuit board is in the second cavity, a circuit pad of the circuit board is accessible from the first cavity; and a biasing wedge that forces the electrical conductor towards the second cavity when the elongated electrical conductor is inserted into the first cavity.

18. The assembly as in claim 17, wherein the biasing wedge is angled with respect to the axis.

19. The assembly as in claim 17, wherein the biasing wedge is further configured such that when the circuit board is located within the second cavity, insertion of the elongated electrical conductor into the first cavity results in the biasing wedge forcing the electrical connector into contact with the circuit pad.

* * * * *